US009751334B2

(12) United States Patent
Hara et al.

(10) Patent No.: US 9,751,334 B2
(45) Date of Patent: Sep. 5, 2017

(54) LIQUID EJECTING APPARATUS AND HEATING UNIT CONTROL METHOD

(71) Applicant: SEIKO EPSON CORPORATION, Tokyo (JP)

(72) Inventors: Osamu Hara, Matsumoto (JP); Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/667,816

(22) Filed: Mar. 25, 2015

(65) Prior Publication Data

US 2015/0273870 A1 Oct. 1, 2015

(30) Foreign Application Priority Data

Mar. 27, 2014 (JP) ..... 2014-065414

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

2003/0161552 A1* 8/2003 Shima ..... B41J 11/002 382/312
2009/0208238 A1* 8/2009 Higashi ..... G03G 15/2039 399/69
2012/0287196 A1* 11/2012 Boland ..... B41J 11/002 347/16
2013/0044153 A1* 2/2013 Sasaki et al. ..... 347/16

FOREIGN PATENT DOCUMENTS

JP 2008-116680 5/2008
JP 2009-251408 10/2009
JP 2011-143626 7/2011

* cited by examiner

*Primary Examiner* — Manish S Shah
*Assistant Examiner* — Jeffrey C Morgan
(74) *Attorney, Agent, or Firm* — Workman Nydegger

(57) ABSTRACT

A liquid ejecting apparatus includes a heating unit; a detecting unit capable of detecting the energies of plural detection areas in a heating area to be heated by the heating unit; and a controller that controls the heating unit on the basis of the energies of the plural detection areas detected by the detecting unit. The controller controls the number of detection areas which are used in control of the heating unit in a case where a medium has been transported to a position where the medium overlaps with at least one of the plural detection areas so that the number is larger than the number of detection areas which are used in the control of the heating unit in a case where a medium has been transported to a position where the medium does not overlap with at least one of the plural detection areas.

5 Claims, 7 Drawing Sheets

LIQUID EJECTING APPARATUS AND HEATING UNIT CONTROL METHOD

BACKGROUND

1. Technical Field

The present invention relates to a liquid ejecting apparatus and a heating unit control method.

2. Related Art

Many liquid ejecting apparatuses which are capable of ejecting liquid to a medium have been used. Some of these liquid ejecting apparatuses are capable of heating the medium.

JP-A-2009-251408 disclose a configuration of an image forming apparatus using a thermal transfer system which is capable of detecting the surface temperature of recording paper (a medium) by a sensor although it is not a liquid ejecting apparatus which is capable of ejecting liquid to a medium.

The image forming apparatus disclosed in JP-A-2009-251408 controls the temperature of a heating roller that serves as a heating unit on the basis of the detection result of a sensor. The image forming apparatus continues certain detection control using the sensor even if recording paper is not detected. This may lead to fluctuations in the detected temperature of the heating roller and erroneous temperature control depending on whether the recording paper is detected. In addition, since the sensor is capable of detecting the surface temperature of the recording paper in only one detection area, the temperature of the heating roller may not be controlled appropriately when the surface temperature distribution of the recording paper is uneven.

SUMMARY

An advantage of some aspects of the invention is that the heating unit of the liquid ejecting apparatus is controlled appropriately.

A liquid ejecting apparatus according to a first aspect of the invention includes a transport unit that transports a medium; a liquid ejecting unit that is capable of ejecting liquid to the medium; a heating unit that is capable of heating the medium; a detecting unit that is capable of detecting the energies of plural detection areas in a heating area to be heated by the heating unit; and a controller that controls the heating unit on the basis of the energies of the plural detection areas detected by the detecting unit. The controller controls the number of detection areas which are used in the control of the heating unit in a case where a medium has been transported to a position where the medium overlaps with at least one of the plural detection areas so that the number is larger than the number of detection areas which are used in the control of the heating unit in a case where a medium has been transported to a position where the medium does not overlap with at least one of the plural detection areas.

In the liquid ejecting apparatus according to the aspect of the invention, on the basis of a difference between the energies of the plural detection areas, the controller determines whether or not the medium is transported to a position where the medium overlaps with at least one of the plural detection areas.

The liquid ejecting apparatus according to the aspect of the invention further includes a medium supporting portion that has an opening and that supports the medium; and a detectable portion that is provided in the opening, the detectable portion having an energy which is detected by the detecting unit. The detectable portion includes one or more of the plural detection areas.

In the liquid ejecting apparatus according to the aspect of the invention, the plural detection areas are arranged in a medium transport direction, and on the basis of energy variation among the individual plural detection areas arranged in the medium transport direction, the controller determines the position of an end of the medium in the transport direction.

A heating unit control method according to a second aspect of the invention is a method for controlling a liquid ejecting apparatus having a heating unit that is capable of heating a medium and a detecting unit that is capable of detecting the energies of plural detection areas in a heating area to be heated by the heating unit. The heating unit control method controls the number of detection areas which are used in the control of the heating unit in a case where a medium has been transported to a position where the medium overlaps with at least one of the plural detection areas so that the number is larger than the number of detection areas which are used in the control of the heating unit in a case where a medium has been transported to a position where the medium does not overlap with at least one of the plural detection areas.

According to the aspects of the invention, the heating unit of the liquid ejecting apparatus is controlled appropriately.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording apparatus, which serves as a liquid ejecting apparatus, according to an embodiment of the invention will be described below with reference to figures.

First Embodiment, FIGS. 1 to 4

Figure 1:
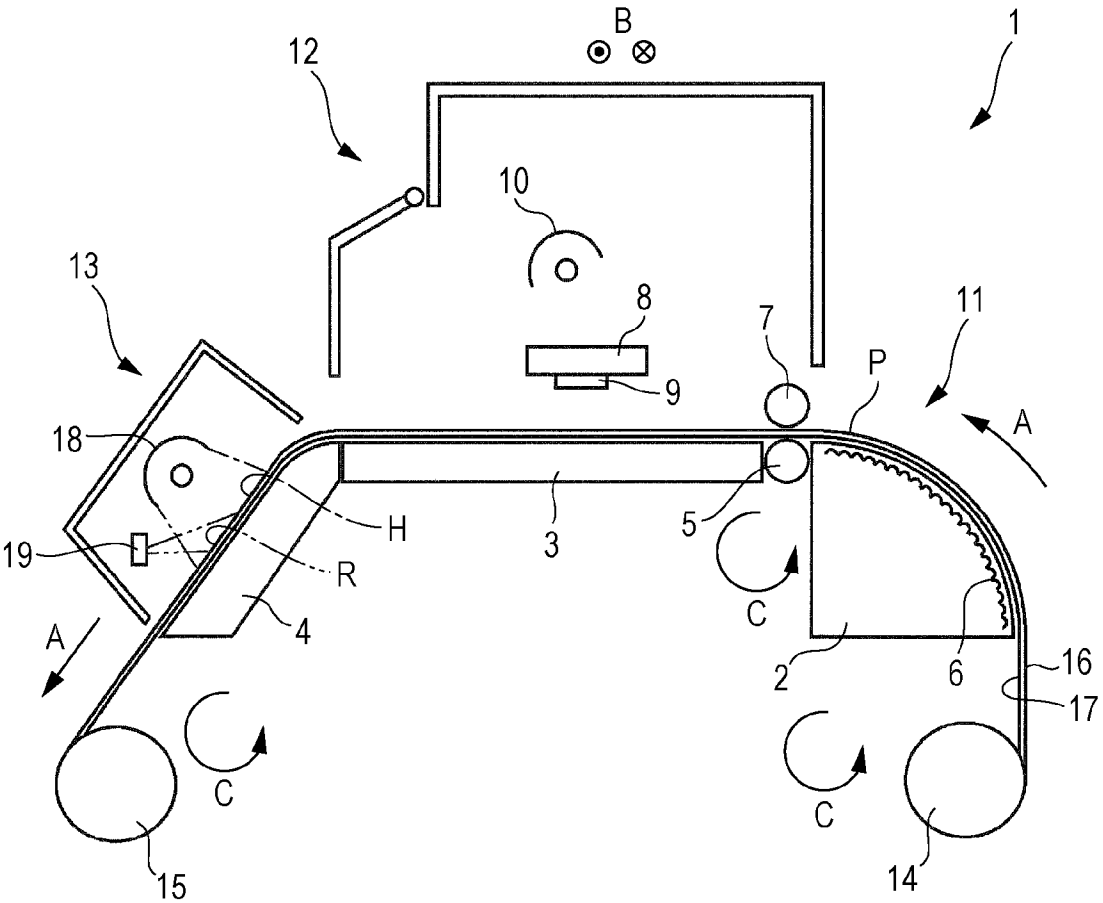
FIG. 1 is a side view schematically illustrating a recording apparatus according to a first embodiment of the invention.

First, the recording apparatus 1 according to the first embodiment will be schematically described. FIG. 1 is a side view schematically illustrating the recording apparatus 1 according to the first embodiment.

As illustrated in FIG. 1, the recording apparatus 1 according to the first embodiment transports a recording medium P from a setting unit 14 for the recording medium P to a winding unit 15 for the recording medium P in a transport direction A via medium supporting portions 2, 3, and 4 which are supporting portions for supporting the recording medium P. That is, the transporting path of the recording medium P in the recording apparatus 1 is a path from the setting unit 14 to the winding unit 15. The medium supporting portions 2 to 4 are supporting portions of the recording medium P which are provided along the transporting path. The setting unit 14 rotates in a rotation direction C so as to feed the recording medium P. The winding unit 15 rotates in the rotation direction C so as to roll up the recording medium P.

The recording apparatus 1 according to the first embodiment is configured to be capable of recording on a roll-type recording medium P. The configuration of the recording apparatus 1 is not limited thereto. The recording apparatus 1 may be configured to be capable of recording on a cut sheet-like recording medium P. In the case where the recording apparatus 1 is configured to be capable of recording on a cut sheet-like recording medium P, a so-called paper feeding tray (a feeding tray), a so-called paper feeding cassette (a feeding cassette), or the like may be used as the setting unit 14 for the recording medium P. A so-called collecting portion for discharging, a so-called paper discharging tray (discharging tray), a so-called paper discharging cassette (discharging cassette), or the like may be used, for example, as the collecting portion for the recording medium P other than the winding unit 15.

In the first embodiment, the roll-type recording medium P, which is rolled up so that a recording surface 16 faces outwards, is used. When the recording medium P is fed from the setting unit 14, the rotation shaft of the setting unit 14 rotates in the rotation direction C. On the contrary, in the case where the recording apparatus 1 uses a roll-type recording medium P which is rolled up so that a recording surface 16 faces inwards, the rotation shaft of the setting unit 14 rotates in a direction opposite to the rotation direction C, and the recording medium P is fed.

Similarly, in the first embodiment, since the winding unit 15 rolls up the recording medium P so that the recording surface 16 of the recording medium P faces outwards, the rotation shaft of the winding unit 15 rotates in the rotation direction C. On the contrary, in the case where the winding unit 15 rolls up the recording medium P so that the recording surface 16 of the recording medium P faces inwards, the rotation shaft of the setting unit 14 rotates in a direction opposite to the rotation direction C, and the recording medium P is rolled up.

A heater 6 is provided in the medium supporting portion 2 of the recording apparatus 1 according to the first embodiment. The heater 6 is provided for heating (so-called pre-heating) the recording medium P before a recording head 9, which serves as a recording unit, records.

In the recording apparatus 1 according to the first embodiment, the heater 6 pre-heats the recording medium P from the surface 17 side opposite to the recording surface 16 side of the recording medium P. However, for example, the recording medium P may be pre-heated from the recording surface 16 side using a heater which is capable of radiating infrared rays to the recording medium P from the recording surface 16 side for heating the recording medium P.

The recording apparatus 1 according to the first embodiment has a driving roller 5 between the medium supporting portion 2 and the medium supporting portion 3. The driving roller 5 has a rotation shaft whose axial direction is a direction B crossing the transport direction A. The driving roller 5 applies a feeding force to the surface 17 of the recording medium P. A driven roller 7 is provided at a position (upper portion) facing the driving roller 5. The driven roller 7 has a rotation shaft whose axial direction is the direction B. The driving roller 5 and the driven roller 7, which form a pair of rollers that serve as a transport unit, pinch and transport the recording medium P. Herein, the driven roller refers to a roller which is rotated with the transport of the recording medium P.

The recording apparatus 1 according to the first embodiment has the recording head 9 as a liquid ejecting unit at the side facing the medium supporting portion 3. While the recording apparatus 1 reciprocates the recording head 9 in the direction B crossing the transport direction A via carriage 8, ink is ejected to the recording medium P from the ink ejection surface of the recording head 9 to form a desired image.

The recording apparatus 1 according to the first embodiment has the recording head 9 which records while reciprocating. The recording apparatus 1 may have a so-called line head in which nozzles for ejecting ink are arranged in the direction B crossing the transport direction A.

Herein, the "line head" is a recording head used in a recording apparatus in which a region of nozzles arranged in the direction B crossing the transport direction A of the recording medium P is provided so as to cover the recording medium P entirely in the direction B, the recording apparatus forming an image by keeping one of the recording head and the recording medium P fixed while moving the other. Depending on the recording apparatus, the region of nozzles arranged in the direction B does not have to cover all kinds of recording media P to be used in the recording apparatus entirely in the direction B.

A heater 10 which serves as a heating unit is provided at a position facing the medium supporting portion 3 and above the recording head 9. The heater 10 is capable of irradiating a recording area of the recording head 9 with an electromagnetic wave.

In the first embodiment, the heater 10 is an infrared heater which is provided at a position facing the medium supporting portion 3 and is capable of heating the recording surface 16 side surface of the recording medium P in the range of 35° C. to 50° C.

A heater 18, which is capable of radiating an electromagnetic wave, is provided at the downstream side of the medium supporting portion 3 in the transport direction A and at a position facing the medium supporting portion 4. The heater 18 is an infrared heater which is capable of heating the surface of the recording medium P in the range of 60° C. to 120° C. so as to dry ink used in the recording apparatus of the first embodiment. However, the heater 18 is not limited to this kind of drying device.

A sensor 19 (infrared sensor) is provided as a detecting unit which is capable of detecting energies (temperatures) at plural detection areas R (see FIG. 4) within the area (heating area H) where the heater 18 may perform heating.

As described above, the recording apparatus 1 according to the first embodiment has a pre-heat section 11, a print heat section 12, and an after-heat section 13. The pre-heat section 11 pre-heats the recording medium P by using the heater 6. The print heat section 12 heats the recording medium P by using the heater 10 during recording and immediately after recording. The after-heat section 13 heats the recording medium P by using the heater 18 after recording.

The recording apparatus 1 according to the first embodiment has the sensor 19 only in the after-heat section 13. The recording apparatus 1 is not limited to this configuration and may have a sensor in the pre-heat section 11 or the print heat section 12. The types of heating units of the pre-heat section 11, the print heat section 12, and the after-heat section 13 are not limited.

Generally, the after-heat section 13 uses high energy. Thus, it is preferable that the sensor 19 be provided in the after-heat section 13 and control described below be performed as the first embodiment.

The electric configuration of the recording apparatus 1 according to the first embodiment will be described.

Figure 2:
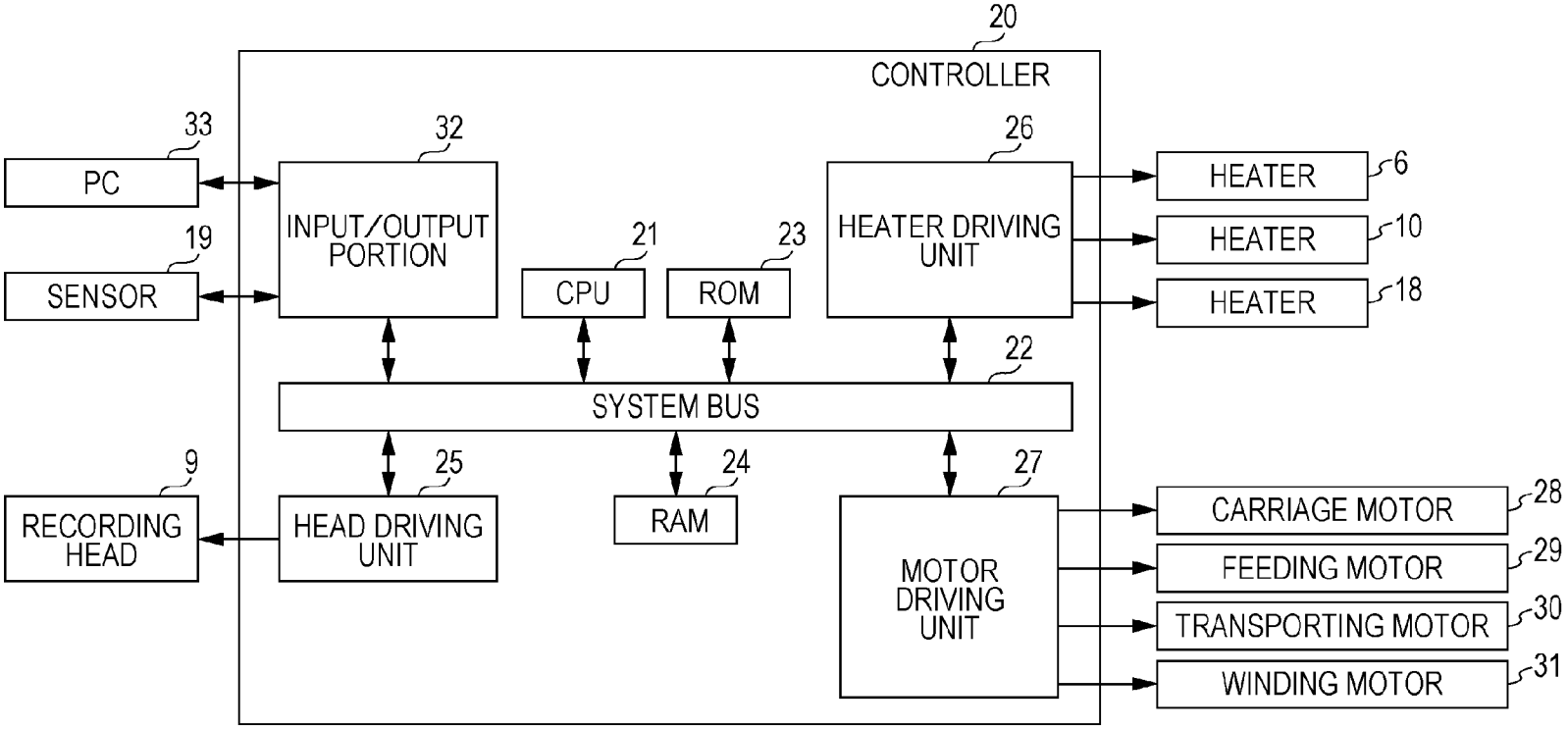
FIG. 2 is a block diagram illustrating the recording apparatus according to the first embodiment of the invention.

FIG. 2 is a block diagram illustrating the recording apparatus 1 according to the first embodiment.

A controller 20 has a central processing unit (CPU) 21 which controls the entire recording apparatus 1. The CPU 21 is connected to a read-only memory (ROM) 23 and a random-access memory (RAM) 24 via a system bus 22. The ROM 23 stores various control programs and the like which are executed by the CPU 21. The RAM 24 is capable of storing data temporarily.

The CPU 21 is connected, via the system bus 22, to a head driving unit 25 which drives the recording head 9.

The CPU 21 is connected, via the system bus 22, to a heater driving unit 26 which drives the heaters 6, 10, and 18.

The CPU 21 is connected, via the system bus 22, to a motor driving unit 27. The motor driving unit 27 drives a carriage motor 28 which moves the carriage 8, a feeding motor 29 which is a driving source of the setting unit 14, a transporting motor 30 which is a driving source of the driving roller 5, and a winding motor 31 which is a driving source of the winding unit 15.

The CPU 21 is connected, via the system bus 22, to an input/output portion 32. The input/output portion 32 is connected to the sensor 19 and a personal computer (PC) 33 which is used to input recording data and the like to the recording apparatus 1.

Next, the detection areas R of the sensor 19 will be described.

Figure 3:
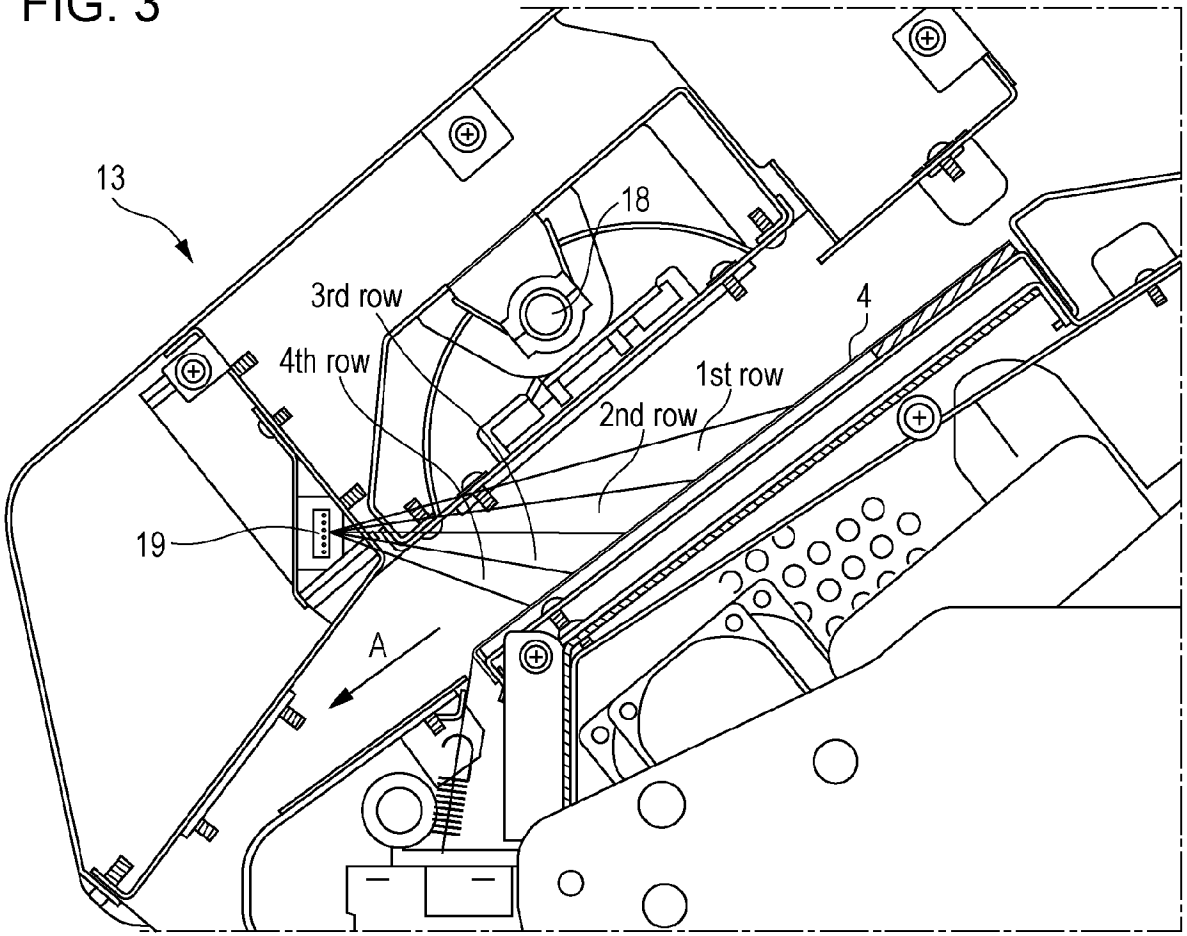
FIG. 3 is a side view schematically illustrating a principal portion of the recording apparatus according to the first embodiment of the invention.
Figure 4:
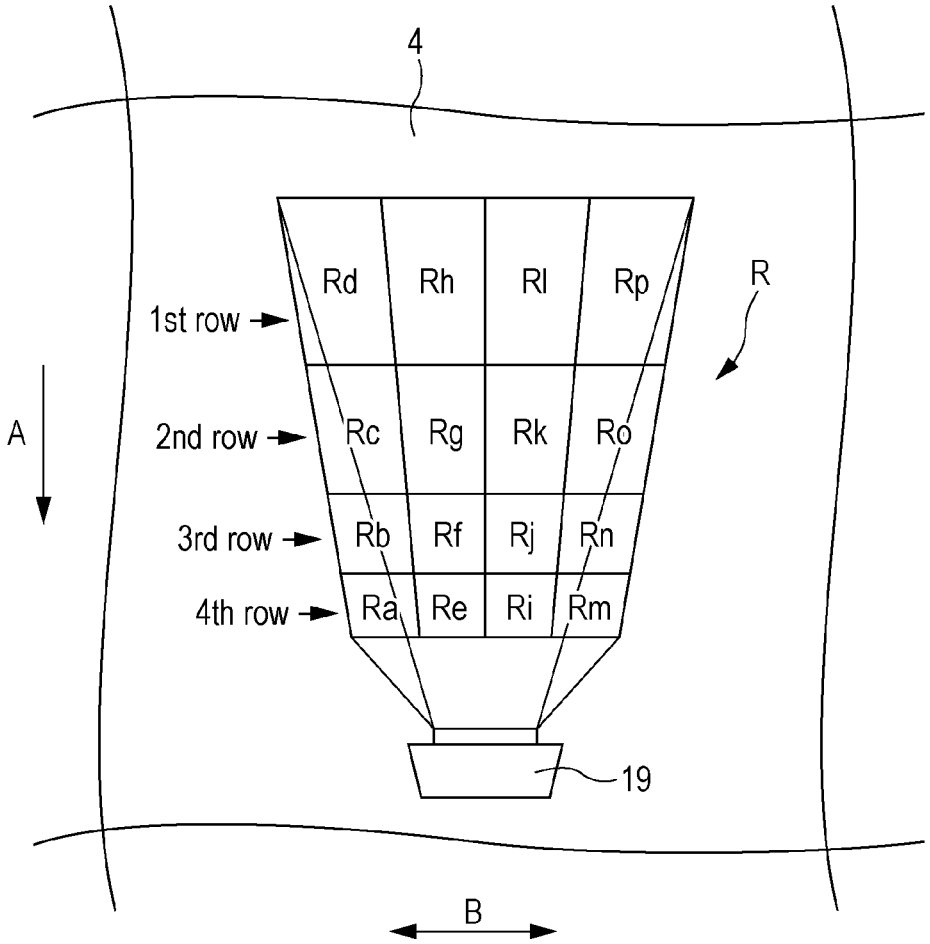
FIG. 4 is a plan view schematically illustrating a principal portion of the recording apparatus according to the first embodiment of the invention.

FIG. 3 is a side view schematically illustrating the after-heat section 13 as a principal portion of the recording apparatus 1 according to the first embodiment of the invention. FIG. 4 is a plan view schematically illustrating the after-heat section 13 as the principal portion of the recording apparatus 1 according to the first embodiment of the invention and the position of the detection areas R, on the medium supporting portion 4, of the sensor 19 from above. FIG. 4 corresponds to a view from a direction which is about 45 degrees relative to a supporting surface of the medium supporting portion 4.

As described above, the sensor 19 in the first embodiment is capable of detecting the energies of the plural detection areas R. Specifically, as illustrated in FIG. 4, the sensor 19 is capable of detecting the energies of detection areas Ra to Rp which are 16 detection areas in total.

The detection areas R illustrated in FIG. 4 are constituted by the first row (1st row) to the fourth row (4th row) in the direction B crossing the transport direction A. Each row has four areas. Although it is not illustrated, the sensor 19 according to the first embodiment is capable of detecting the energies of eight areas for eight individual rows (i.e., 64 areas in total) including the first row (1st row) to the fourth row (4th row).

As described above, the recording apparatus 1 according to the first embodiment includes transport units 5 and 7, the recording head 9, the heater 18, and sensor 19. The transport units 5 and 7 transport the recording medium P. The recording head 9 is capable of ejecting ink as liquid to the recording medium P. The heater 18 is capable of heating the recording medium P. The sensor 19 is capable of detecting the energies of the plural detection areas R which are included in the heating area H heated by the heater 18.

The controller 20 controls the heater 18 on the basis of the energies of the plural detection areas R detected by the sensor 19.

Among the plural detection areas R, the number of detection areas R which are used in the control of the heater 18 is controlled by the controller 20 so as to increase as the recording medium P is transported to a position where the recording medium P overlaps with at least one of the plural detection areas R. Specifically, before the recording medium P is transported to the fourth row (4th row) which is a position including at least one of the plural detection areas R, the detection areas R used in the control of the heater 18 are set to detection areas Rf and Rj and the number thereof is set to two. After the recording medium P is transported to the fourth row (4th row), the detection areas R used in the control of the heater 18 are set to detection areas Ra to Rp and the number thereof is set to 16. Upon the recording medium P being transported out of the position including the at least one of the plural detection areas R, the detection areas R, which are used in the control of the heater 18, of the plural detection areas R are returned to detection areas Rf and Rj from detection areas Ra to Rp and the number thereof is returned to 2 from 16.

When the heating unit 18 heats the recording medium P to which ink has been ejected, the temperature distribution of the recording medium P may become uneven between a part where ink has been ejected and a part where ink has not been ejected. For example, in the case where the recording medium P is heated by the heater 18, the temperature of the part where ink has been ejected does not rise readily and the temperature of the part where ink has not been ejected rises readily. The way in which temperature rises differs between a part where a large amount of ink has been ejected and a part where a small amount of ink has been ejected. Thus, the temperature distribution may become uneven.

Herein, as mentioned above, in the recording apparatus 1 according to the first embodiment, the sensor 19 increases the number of the detection areas R which are used in the control of the heater 18 larger as the recording medium P is transported to the fourth row (4th row).

Thus, in the case where the recording medium P is in the detection areas R, the number of the detection areas R which are used in the control of the heater 18 is controlled so as to increase, so that the control of the heater 18 is not influenced by the uneven temperature distribution of the recording medium P. For example, by using the average of a part (low temperature part) where a large amount of ink has been ejected and a part (high temperature part) where ink has not been ejected, excessive heating and insufficient heating by the heater 18 is suppressed.

In the case where the recording medium P is not in the detection areas R, the heater 18 does not have to be controlled with high accuracy. Thus, the number of the detection areas R which are used in the control of the heater 18 is controlled to be small, so that no unnecessary load is applied to the recording apparatus 1.

Thus, the heater 18 is controlled appropriately.

In the first embodiment, on the basis of the difference between the energies of the plural detection areas R, the controller 20 determines whether or not the recording medium P has been transported to a position where the recording medium P overlaps with at least one of the plural detection areas R (a position where the sensor 19 is capable of detecting the energy of the recording medium P). Specifically, the controller 20 performs determination on the basis of the difference between the average detected energy of the detection areas Rf and Rj in the plural detection areas R and that of the detection areas Ra, Re, Ri, and Rm in the plural detection areas R.

In this way, on the basis of the difference between the energies of the plural detection areas R, it may be determined whether or not the recording medium P has been transported to a position where the recording medium P overlaps with at least one of the plural detection areas R. This configuration makes it possible to determine accurately without separately providing a determining unit whether or not the recording medium P has been transported to a position where the sensor 19 is capable of detecting the energy of the recording medium P. The heater 18 can be controlled appropriately with high accuracy.

When a situation in which the recording medium P is not in the detection areas R changes to a situation in which the recording medium P is transported to the detection areas R, the recording medium P is transported to a region which has been heated by the heater 18. Thus, a temperature difference (energy difference detected by the sensor 19) occurs. For example, when the recording medium P is transported to the detection areas Rd, Rh, Rl, and Rp which are in the first row (1st row), the sensor 19 is capable of detecting the temperature differences among the detection areas Rd, Rh, Rl, and Rp. Thus, in the first embodiment, for example, by detecting that the energy differences among the plural detection areas R increase, it can be determined that the recording medium P overlaps with a part of the plural detection areas R and does not overlap with the other part of the plural detection areas R.

Accordingly, in the first embodiment, the controller 20 compares the detected energies of different detection areas so as to determine whether or not the recording medium P is transported to the above-mentioned position. Furthermore, when the controller 20 detects a certain change in the detected energy of the same detection area, the controller 20 determines whether or not the recording medium P is transported to the above-mentioned position.

In the first embodiment, on the basis of the detected energy change of at least one of the plural detection areas R, the controller 20 is capable of determining the position of the end of the recording medium P in the transport direction A. For example, on the basis of the temperature changes of the detection areas Rd, Rh, Rl, and Rp of the plural detection areas R, it can be determined whether the end of the recording medium P in the transport direction A is in the detection areas Rd, Rh, Rl, and Rp.

As mentioned above, when a situation in which the recording medium P is not in the detection areas R changes to a situation in which the recording medium P is transported to the detection areas R, the recording medium P is transported to a region which has been heated by the heater 18. Thus, a temperature difference occurs.

As mentioned above, in the recording apparatus 1 according to the first embodiment, on the basis of the detected energy change of at least one of the plural detection areas R, the controller 20 is capable of determining the position of the end of the recording medium P in the transport direction A. That is, the sensor 19 senses the temperature change caused by the recording medium P being transported to the region which has been heated by the heater 18. Thus, the controller 20 can determine that the leading end of the recording medium P in the transport direction A has been transported to the region.

The recording apparatus 1 according to the first embodiment has plural detection areas as the plural detection areas R corresponding to the first row (1st row) to the fourth row (4th row) in the transport direction A of the recording medium P. On the basis of the individual detected energy changes of the plural detection areas R in the transport direction A, the controller 20 can determine the position of the end of the recording medium P in the transport direction A.

In other words, in the recording apparatus 1 according to the first embodiment, there are four rows of detection areas R in the transport direction A. Thus, using individual temperature changes of detection areas R in the corresponding row, the controller 20 is capable of determining which row of the first row (1st row) to the fourth row (4th row) the end of the recording medium P in the transport direction A is in. Therefore, the end of the recording medium P in the transport direction A can be determined appropriately with high accuracy.

The heating time of the heater 18 increases as the recording medium P is transported from the first row (1st row) to the fourth row (4th row). Thus, the temperature difference between the recording medium P and the region which has been heated by the heating unit 18 in the case where the recording medium P is still remains in only the first row (1st row) may be larger than in the case where the recording medium P has been transported further along. This is because the recording medium P which is in the first row (1st row) has yet to be heated sufficiently while the region has already been heated by the heating unit 18. In this case, in order to determine that the end of the recording medium P has been transported on the basis of any one of the first row (1st row) to the fourth row (4th row), it is preferable to use the temperature change of the detection areas Rd, Rh, Rl, and Rp in the first row (1st row).

In the case where a supporting face for supporting the recording medium P in the medium supporting portion 4 is formed of stainless steel or the like having high thermal conductivity, the temperature of a region which has been heated by the heating unit 18 may be lower than the temperature of the recording medium P to be transported. This is because the heat radiation effect at the medium supporting portion 4 is high, and, as a result, the medium supporting portion 4 is not heated up sufficiently in comparison with the heated recording medium P. In this case, as the recording medium P is transported from the first row (1st row) to the fourth row (4th row), the temperature of the recording medium P becomes higher and the temperature difference between the recording medium P and the medium supporting portion 4 may increase. In this case, to determine the transportation of the end of the recording medium P by any one of the first row (1st row) to the fourth row (4th row), it is preferable to use the temperature change of the detection areas Ra, Re, Ri, and Rm in the fourth row (4th row).

In the first embodiment, on the basis of the average temperature change of the plural detection areas (for example, the detection areas Ra, Re, Ri, and Rm in the fourth row (4th row)), the position of the end of the recording medium P in the transport direction A can be determined. However, the determination method is not limited to this method, for example, the position of the end of the recording medium P in the transport direction A may be determined on the basis of the temperature change of one detection area (for example, the detection area Ra only in the fourth row (4th row)). However, the determination method for determining the position of the end of the recording medium P in the transport direction A on the basis of the average temperature change of the plural detection areas is less influenced by the uneven temperature distribution, and can determine the position of the end of the recording medium P in the transport direction A with higher accuracy than the method using the temperature change of only one detection area.

Figure 5:
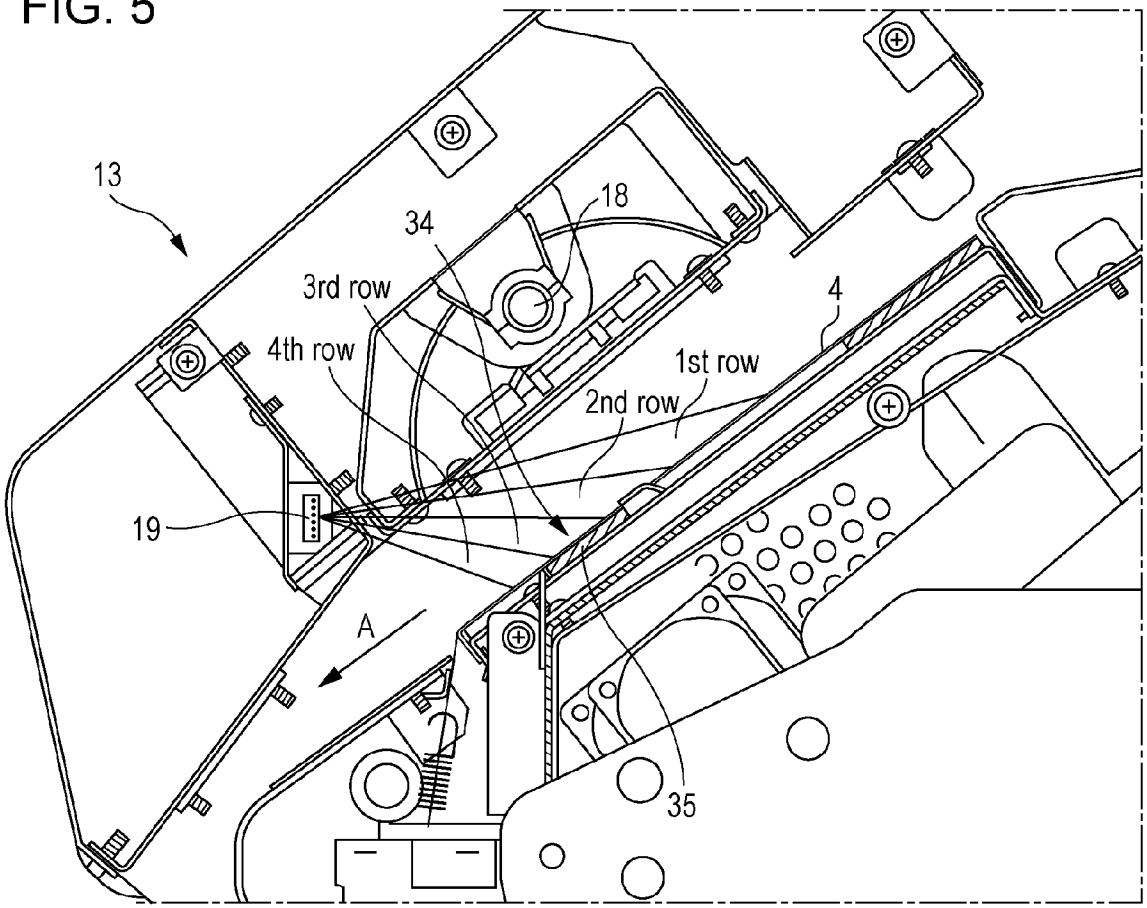
FIG. 5 is a side view schematically illustrating a principal portion of a recording apparatus according to a second embodiment of the invention.
Figure 6:
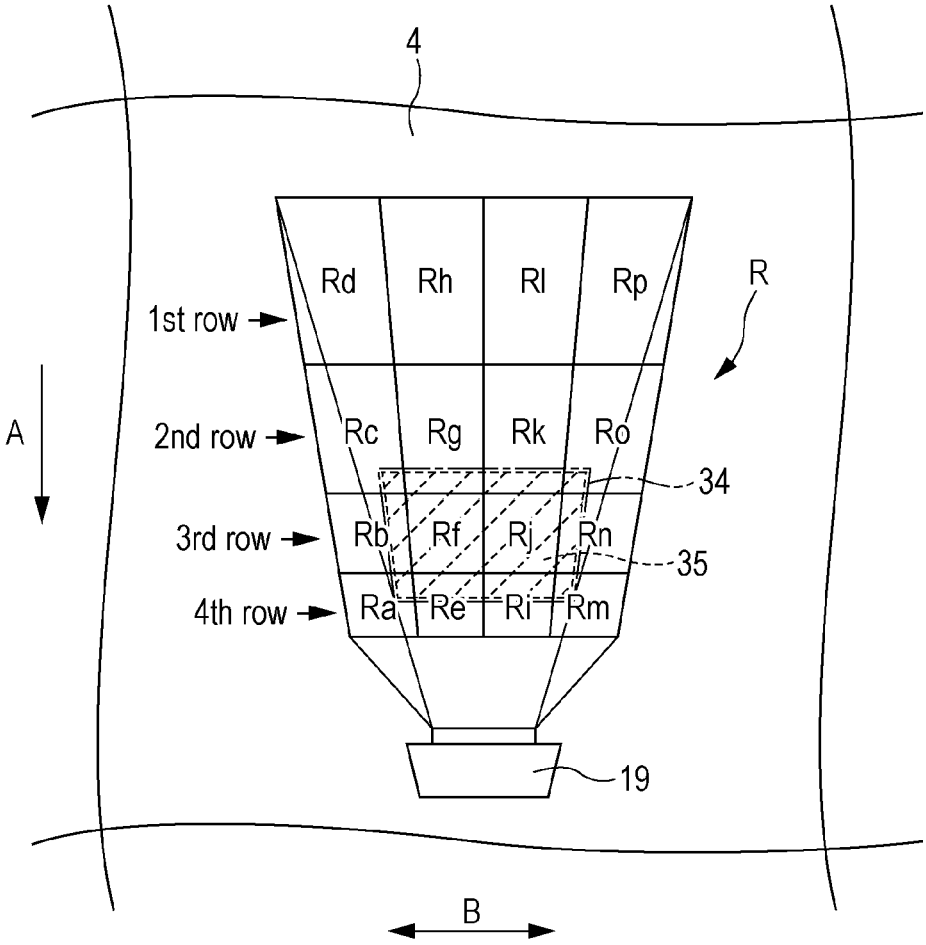
FIG. 6 is a plan view schematically illustrating a principal portion of the recording apparatus according to the second embodiment of the invention.

Second Embodiment, FIGS. 5 and 6

Next, a recording apparatus according to the second embodiment of the invention will be described with references to FIGS. 5 and 6.

FIG. 5 corresponds to FIG. 3 illustrating the recording apparatus 1 according to the first embodiment and is a side view schematically illustrating an after-heat section 13 as a principal portion of the recording apparatus 1 according to the second embodiment of the invention. FIG. 6 corresponds to FIG. 4 of the recording apparatus 1 according to the first embodiment, and is a plan view schematically illustrating detection areas R, on the medium supporting portion 4, of the sensor 19 in the after-heat section 13 as the principal portion of the recording apparatus 1 according to the second embodiment of the invention. FIG. 6 corresponds to a view from a direction which is about 45 degrees relative to the supporting surface of the medium supporting portion 4. Elements the same as those in the first embodiment are denoted by the same reference symbols and description thereof is omitted.

In the recording apparatus 1 according to the second embodiment, the configuration is similar to or the same as that of the recording apparatus 1 according to the first embodiment except for an opening 34, which is provided at the medium supporting portion 4, and a detectable portion 35, which is provided at the position corresponding to the opening 34.

As illustrated in FIGS. 5 and 6, in the second embodiment, the opening 34 is provided at the medium supporting portion 4. As illustrated in FIGS. 5 and 6, the detectable portion 35 is provided at the position which corresponds to the opening 34 and at which the sensor 19 is capable of detecting energy.

Detection areas Rf and Rj correspond to the position of the detectable portion 35. That is, the detection areas Rf and Rj are included in the detectable portion 35. The heat storage capacity of the detectable portion 35 is equal to or similar to that of the recording medium P which is assumed to be used.

As illustrated in FIGS. 5 and 6, the recording apparatus 1 according to the second embodiment includes the medium supporting portion 4 and the detectable portion 35. The medium supporting portion 4 has the opening 34 and supports the recording medium P. The detectable portion 35 is provided in the opening 34 and the energy thereof is detected by the sensor 19.

The detectable portion 35 includes some of the plural detection areas R, specifically, detection areas Rf and Rj to be used in the control of the heater 18 when the energy of the recording medium P is not being detected.

Herein, as mentioned above, the heat storage capacity of the detectable portion 35 is equal to or similar to that of the recording medium P which is assumed to be used.

Thus, even if the recording medium P is not in the detection areas R, the heater 18 can be controlled appropriately.

In detail, the recording apparatus 1 according to the second embodiment includes the detectable portion 35 which has a heat storage capacity equal to or similar to that of the recording medium P which is assumed to be used. The other portion of the medium supporting portion 4 except for the detectable portion 35 is formed of, for example, stainless steel. The heat storage capacity of the other portion is not equal to or similar to that of the recording medium P which is assumed to be used (thermal conductivity is high, so that temperature decreases readily). Thus, before the recording medium P is transported to the plural detection areas R, the detected energies (temperatures) of the detection areas Rf and Rj are different from those of the other detection areas. Specifically, the temperatures of the other detection areas are lower than those of the detection areas Rf and Rj. Therefore, compared with the case where the control of the heater 18 is performed when the recording medium P is in the detection areas R or the case where the control of the heater 18 is performed on the basis of the temperature of the detection areas Rf and Rj, the control of the heater 18 that is performed on the basis of the temperature of detection areas other than the detection areas Rf and Rj results in an excessive load being applied to the heater 18 and the recording medium P being excessively heated. This is because, for example, the output amount A of the heater 18 needed to heat the other portion of the medium supporting portion 4 except for the detectable portion 35 at 100° C. is larger than the output amount B of the heater 18 needed to heat the recording medium P or the detectable portion 35 at 100° C., so that heating the recording medium P with the output amount A leads to excessive heating. Therefore, the recording apparatus 1 according to the second embodiment is capable of suppressing excessive heating of the recording medium P and is capable of saving energy.

The heat storage capacity of the detectable portion 35 is equal to or similar to that of the recording medium P which is assumed to be used. Thus, for example, by controlling the transport speed of the recording medium P to lengthen the time for transporting the recording medium P from the heating area H to the detection areas R, the temperature of the recording medium P when the recording medium P is transported to the detection areas R can be controlled so that it becomes equal to or similar to the temperature of the detectable portion 35. For example, in the case where the recording medium P is heated at 100° C., if the heat storage capacity of the detectable portion 35 is equal to or similar to that of the recording medium P, the detectable portion 35 is also heated at 100° C. Thus, the temperature of the recording medium P when the recording medium P is transported to the detection areas R can be controlled so as to become 100° C.

By such control, the controller 20 of the second embodiment is capable of determining that the recording medium P is transported to the position where the recording medium P overlaps with at least one of the plural detection areas R when the temperature of one of the plural detection areas R except for the detection area at which the temperature of the detectable portion 35 can be detected become equal to or similar to the temperature of the detectable portion 35.

Figure 7:
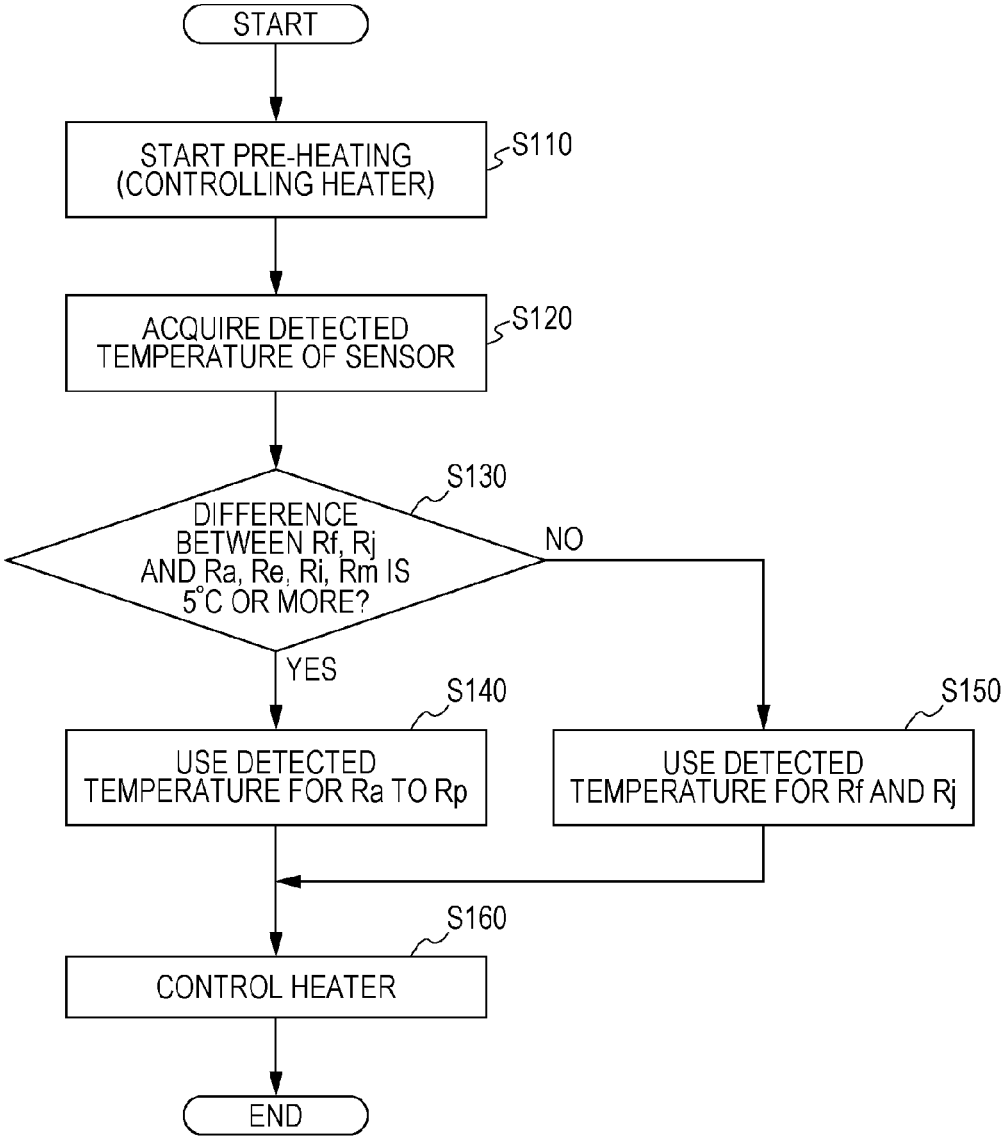
FIG. 7 is a flowchart illustrating a heating unit control method according to an embodiment of the invention.

Example of Heating Unit Control Method, FIG. 7

Next, an example of the heating unit control method using the recording apparatus 1 according to the second embodiment will be described.

FIG. 7 is a flowchart illustrating the heating unit control method according to an embodiment of the invention.

When recording data is input from the PC 33 and the heating unit control method according to the embodiment is started, first, in step S110, the heater 18 is pre-heated by the control of the controller 20.

Next, in step S120, the controller 20 acquires the detected temperature of the sensor 19 at predetermined intervals.

Next, in step S130, the controller 20 determines whether the difference between the average temperature of the detection areas Rf and Rj and that of the detection areas Ra, Re, Ri, and Rm is 5° C. or more. In the embodiment, the threshold for determination is set to 5° C. However, the threshold is not limited to 5° C. In the embodiment, the difference between the average temperature of the detection areas Ra, Re, Ri, and Rm in the fourth row (4th row) and that of the detection areas Rf and Rj in the third row (3rd row) is used as a determination criteria. But other average temperature except for that of the detection areas Ra, Re, Ri, and Rm in the fourth row (4th row) may be used as the determination criteria.

In step S130, when the controller 20 determines that the difference between the average temperature of the detection areas Rf and Rj and that of the detection areas Ra, Re, Ri, and Rm is 5° C. or more, the process proceeds to step S140. When the controller 20 determines that the difference is less than 5° C., the process proceeds to step S150.

The case where the controller 20 determines that the difference is 5° C. or more corresponds to the case where the controller 20 determines that the recording medium P is not in the detection areas R. The case where the controller 20 determines that the difference is less than 5° C. corresponds to the case where the controller 20 determines that the recording medium P is in the detection areas R.

In step S140, by the control of the controller 20, the detection areas Rf and Rj are set as the detection areas to be used for controlling the heater 18 among the plural detection areas R.

In step S150, by the control of the controller 20, the detection areas Ra to Rp are set as the detection areas to be used for controlling the heater 18 among the plural detection areas R.

Next, in step S160, the heater 18 is controlled on the basis of the energies detected in the detection areas R set in step S140 or step S150.

In this way, in the heating unit control method according to the embodiment, the number of the detection areas used for controlling the heater 18 in the plural detection areas R is controlled to be larger as the recording medium P is transported to the position where the recording medium P overlaps with at least one of the plural detection areas R. Thus, in the case where the recording medium P is in the detection areas R, the number of the detection areas R which are used in the control of the heater 18 is controlled to be larger, so that the control of the heater 18 cannot be easily influenced by the uneven temperature distribution of the recording medium P. In the case where the recording medium P is not in the detection areas R, the number of the detection areas R which are used in the control of the heater 18 is controlled to be small, so that no unnecessary load is applied to the liquid ejecting apparatus 1.

Thus, the heater 18 can be controlled appropriately.

The invention is not limited to the above embodiments. The embodiments may be modified in various ways within the scope of the invention. It goes without saying that the various modifications of the embodiments are within the scope of the invention.

Specifically, for example, each of the above embodiments has a configuration in which the heater 18 is controlled. However, each of the embodiments is not limited to this configuration. For example, the heater 6 in the pre-heat section 11 or the heater 10 in the print heat section 12 may be controlled. In this case, the sensor 19 is preferably provided so as to correspond to the heater 6 or the heater 10.

In the above description, the specific embodiments of the invention are described. All of the embodiments of the invention are summarized here.

The liquid ejecting apparatus 1 according to the first aspect of the invention includes the transport units 5 and 7, the liquid ejecting unit 9, the heating unit 18, the detecting unit 19, and the controller 20. The transport units 5 and 7 transport the medium P. The liquid ejecting unit 9 is capable of ejecting liquid to the medium P. The heating unit 18 is capable of heating the medium P. The detecting unit 19 is capable of detecting the energies of the plural detection areas R in the heating area H heated by the heating unit 18. The controller 20 controls the heating unit 18 on the basis of the energies of the plural detection areas R detected by the detecting unit 19. The controller 20 controls the number of the detection areas R used for controlling the heating unit 18 among the plural detection areas R so that the number increases as the medium P is transported to the position where the medium P overlaps with at least one of the plural detection areas R.

When the heating unit 18 heats the medium P to which ink is ejected, an uneven temperature distribution of the medium P may occur among the part where ink is ejected, the part where ink is not ejected, and the like. For example, in the case where the medium P is heated by the heating unit 18, the temperature of the part to which ink is ejected does not rise readily and the temperature of the part to which ink is not ejected rises readily.

In the first aspect of the invention, the controller 20 controls the number of the detection areas R used for controlling the heating unit 18 by the detecting unit 19 so that the number increases as the medium P is transported to the position where the medium P overlaps with at least one of the plural detection areas R.

Thus, in the case where the medium P is in the detection areas R, the number of the detection areas R which are used in the control of the heating unit 18 is controlled to be larger, so that the control of the heating unit 18 is not influenced by the uneven temperature distribution of the medium P. For example, by using the average of a part (low temperature part) where a large amount of ink has been ejected and a part (high temperature part) where no ink has been ejected, excessive heating and insufficient heating by the heating unit 18 is suppressed.

In the case where the medium P is not in the detection areas R, the heating unit 18 does not have to be controlled with high accuracy. Thus, the number of the detection areas R which are used in the control of the heating unit 18 is controlled to be small, so that no unnecessary load is applied to the liquid ejecting apparatus 1. Thus, the heating unit 18 is controlled appropriately.

In the liquid ejecting apparatus according to the second aspect of the invention, in the first aspect of the invention, on the basis of the difference among the energies of the plural detection areas R, the controller 20 determines that the medium P has been transported to a position where the medium P overlaps with at least one of the plural detection areas R. On the basis of this determination, the controller 20 performs control so as to increase the number of the detection areas R which are used by the detecting unit 19 in the control of the heating unit 18 among the plural detection areas R.

In the second aspect of the invention, without separately providing a determining unit, it can be accurately determined that the medium P has been transported to a position where the sensor 19 can detect the energy of the medium P. The heater 18 can be controlled appropriately with high accuracy.

The liquid ejecting apparatus according to the third aspect of the invention includes, in the first or second aspect of the invention, the medium supporting portion 4 and the detectable portion 35. The medium supporting portion 4 has the opening 34 and supports the medium P. The detectable portion 35 is provided in the opening 34, and the sensor 19 detects the energy of the detectable portion 35. The detectable portion 35 includes some of the plural detection areas R, specifically, detection areas Rf and Rj.

In the third aspect of the invention, the detectable portion 35 includes some of the plural detection areas R, specifically, detection areas Rf and Rj. Thus, for example, by setting the heat storage capacity of the detectable portion 35 to be equal to that of the medium P which is assumed to be used, the heating unit 18 can be controlled appropriately even if the medium P is not in the detection areas R.

The liquid ejecting apparatus according to the fourth aspect of the invention has, in one of the first to third aspects of the invention, the plural detection areas R arranged in the transport direction A of the medium P. On the basis of the individual detected energy changes of the plural detection areas R in the transport direction A, the controller 20 determines a position of the end of the medium P in the transport direction A.

As mentioned above, when a situation in which the medium P is not in the detection areas R changes to a situation in which the medium P is transported to the detection areas R, the medium P is transported to a region which has been heated by the heating unit 18. Thus, a temperature change occurs.

In the fourth aspect of the invention, on the basis of the detected energy change of at least one of the plural detection areas R, the controller 20 may determine the position of the end of the medium P at plural positions in the transport direction A. That is, at the plural positions in the transport direction A, the temperature changes caused by the medium P being transported to the region which has been heated by the heating unit 18 are detected. Thus, the controller 20 may determine the position of the end of the medium P in the transport direction A with high accuracy. Thus, the controller 20 may detect the end of the medium P in the transport direction A with high accuracy.

The heating unit control method according to the fifth aspect of the invention is a method for controlling the liquid ejecting apparatus 1 having the heating unit 18 that is capable of heating the medium P and the detecting unit 19 that is capable of detecting energies of the plural detection areas R in the heating area H to be heated by the heating unit 18. The heating unit control method controls the number of detection areas, which are used in the control of the heating unit 18, among the plural detection areas R so that the number increases as the medium P is transported to the position where the medium P overlaps with at least one of the plural detection areas R.

According to the fifth embodiment, the number of detection areas R which are used in the control of the heating unit 18 is controlled so that the number increases as the medium P is transported to the position where the medium P overlaps with at least one of the plural detection areas R. Thus, in the case where the medium P is in the detection areas R, the number of the detection areas R which are used in the control of the heating unit 18 is controlled to be larger, so that the control of the heating unit 18 is not influenced readily by the uneven temperature distribution of the medium P.

In the case where the medium P is not in the detection areas R, the number of the detection areas R which are used in the control of the heating unit 18 is controlled to be small, so that no unnecessary load is applied to the liquid ejecting apparatus 1. Thus, the heating unit 18 is controlled appropriately.

The entire disclosure of Japanese Patent Application No. 2014-065414, filed Mar. 27, 2014 is expressly incorporated reference herein.

What is claimed is:

1. A liquid ejecting apparatus comprising:

a transport unit that transports a medium;

a liquid ejecting unit that is capable of ejecting liquid to the medium;

a heating unit that is capable of heating the medium;

a detecting unit that is capable of simultaneously detecting energies from a plurality of detection areas, wherein the detecting unit is downstream of the liquid ejecting unit in a transport direction; and a controller that is capable of controlling the heating unit based on the energies collected by the detecting unit and that is capable of detecting whether the medium overlaps with at least one of the plurality of detection areas based on the energies collected by the detecting unit, wherein a number of detection areas that are used by the controller to control the heating unit is higher in a case where the medium is transported to a position where the medium overlaps with at least one of the plurality of detection areas than in a case where the medium has been transported to a position where the medium does not overlap with at least one of the plurality of detection areas, wherein the controller controls the heating unit based on an average of the energies detected from the plurality of detection areas.

2. The liquid ejecting apparatus according to claim 1, wherein on the basis of a difference between the energies of the plurality of detection areas, the controller determines whether the medium has been transported to the position where the medium overlaps with the at least one of the plurality of detection areas.

3. The liquid ejecting apparatus according to claim 1, further comprising:

a medium supporting portion that has an opening and supports the medium; and a detectable portion that is provided in the opening, and whose energy is detected by the detecting unit, wherein the detectable portion includes one or more of the plurality of detection areas.

4. The liquid ejecting apparatus according to claim 1, wherein the plurality of detection areas are arranged in a medium transport direction, and on the basis of energy changes of the plurality of detection areas arranged in a medium transport direction, the controller determines a position of an end of the medium in the transport direction.

5. A heating unit control method for controlling a liquid ejecting apparatus having a heating unit that is capable of heating a medium and a detecting unit that is capable of simultaneously detecting energies from a plurality of detection areas, the heating unit control method comprising:

controlling the number of detection areas which are used in control of the heating unit to be higher in a case where a medium has been transported to a position downstream in a transport direction from a liquid ejecting unit where the medium overlaps with at least one of the plurality of detection areas than in a case where the medium has been transported to a position where the medium does not overlap with at least one of the plurality of detection areas, wherein the same detecting unit is used to determine when the medium overlaps with the at least one of the plurality of detection areas, and wherein the controller controls the heating unit based on an average of the energies detected from the plurality of detection areas.

* * * * *